US006814316B2

(12) United States Patent
Gromes, Sr.

(10) Patent No.: US 6,814,316 B2
(45) Date of Patent: Nov. 9, 2004

(54) TWO-PIECE NOZZLE ASSEMBLY FOR USE WITH HIGH PRESSURE FLUID CUTTING SYSTEMS AND BUSHING FOR USE THEREWITH

(75) Inventor: Terry Dean Gromes, Sr., Navarre, OH (US)

(73) Assignee: Terydon, Inc., Navarre, OH (US)

( * ) Notice: Subject to any disclaimer, the term of this patent is extended or adjusted under 35 U.S.C. 154(b) by 0 days.

(21) Appl. No.: 10/225,392

(22) Filed: Aug. 20, 2002

(65) Prior Publication Data

US 2004/0035958 A1 Feb. 26, 2004

(51) Int. Cl.[7] ..... B05B 1/00; E21B 7/18
(52) U.S. Cl. ..... 239/596; 239/600
(58) Field of Search ..... 239/596, 600, 239/1

(56) References Cited

U.S. PATENT DOCUMENTS 3,045,932 A * 7/1962 Steinen ..... 239/601
3,750,961 A * 8/1973 Franz ..... 239/600
4,244,521 A * 1/1981 Guse ..... 239/110
4,557,217 A * 12/1985 Zingg ..... 118/300
4,813,611 A * 3/1989 Fontana ..... 239/589
4,852,800 A * 8/1989 Murdock ..... 239/1
5,730,358 A * 3/1998 Raghavan et al. ..... 239/1
5,848,753 A * 12/1998 Wands et al. ..... 239/596
6,168,503 B1 * 1/2001 Pao et al. ..... 451/40

* cited by examiner

*Primary Examiner*—William C. Doerrler
(74) *Attorney, Agent, or Firm*—Sand & Sebolt

(57) ABSTRACT

A high velocity cutting nozzle for connection to the fluid supply tube of a high pressure fluid cutting system. The nozzle includes a housing which threadably connects to the fluid supply tube for receiving pressurized liquid therefrom. A bushing disposed within the housing sandwiches a removable sleeved jeweled orifice disk therebetween at a spray outlet bore of the housing. The bushing includes a flow directing bore with a convergent inlet portion for reducing turbulence, and an outlet portion having an annular cylindrical or divergent inner surface, and an annular convergent angled or curved end surface. The sleeved orifice disk is in co-axial fluid communication with the flow-directing bore and a spray outlet bore of the housing to facilitate fluid flow. The sleeved orifice disk fits within a sleeve receiving bore in the bushing immediately downstream of the flow-directing bore abutting a shoulder of the bushing.

37 Claims, 7 Drawing Sheets

TWO-PIECE NOZZLE ASSEMBLY FOR USE WITH HIGH PRESSURE FLUID CUTTING SYSTEMS AND BUSHING FOR USE THEREWITH

BACKGROUND OF THE INVENTION

1. Technical Field

Generally, the invention relates to high pressure fluid cutting systems. Particularly, the invention relates to high velocity cutting nozzles for connection to the fluid supply tube of high pressure fluid cutting systems. Specifically, the invention relates to cutting nozzles comprising a housing which threadably connects to the fluid supply tube for receiving pressurized liquid therefrom, with a bushing disposed in the housing that sandwiches a removable sleeved orifice disk therebetween at a spray outlet bore of the housing.

2. Background Information

High pressure liquid cutting devices are commonly used for cutting various sheet materials such as plastics, and masonry materials such as brick and concrete slabs. Such cutting devices are also used for drilling and abrading materials. Such devices are also often used to clean materials such as masonary and steel. Such cutting devices usually include an electric motor which drives a hydraulic pump supplying a working fluid to a high pressure intensifier unit. The intensifier draws a cutting liquid in the form of water from a reservoir, and discharges the water at a very high pressure (e.g. 20,000 to 70,000 psi or more) through the fluid supply tube to the cutting nozzle to produce a fluid jet to cut through the desired material. The fluid jet may range in diameter from about a thousandth of an inch up to about fifteen thousandths of an inch or more, at a velocity of about 1,000 to 3,000 feet per second.

Many prior art cutting nozzles are prone to prematurely wearing out due to abrasion caused by the high pressure and velocity of the water traveling through the nozzles upstream of the orifice. Turbulence upstream of the orifice also causes lack of cohesiveness of the fluid jet. That is, convergence of the various velocity vectors of the fluid within the fluid jet at the orifice only extends for a short distance upon exiting the orifice. This results in a more dispersed fluid jet having less cutting force so only shallower cuts may be made, a wider width of cut or kerf, and more overspraying or wetting of the material adjacent the cut. Conversely, a more cohesive fluid jet provides a finer fluid jet, more precise cutting, and deeper cuts.

One attempt to reduce such turbulence is a liquid jet cutting device and method disclosed in U.S. Pat. No. 3,997,111 issued to Thomas et al. on Dec. 14, 1976. The disclosed device includes a source of high pressure fluid, a jet nozzle, and a high pressure conduit connecting the fluid source to the nozzle. A liquid collimating device is disposed directly upstream of the nozzle comprising a housing interconnected between the conduit and the nozzle. The housing defines a flow collimating chamber directly upstream of the nozzle through which the high pressure liquid is delivered to the nozzle. The cross-sectional area of the flow collimating chamber must be at least greater than one hundred times the cross-sectional area of the nozzle opening. The liquid jet produced is claimed to have relatively little dispersion and a relatively narrow kerf.

An orifice assembly and method providing highly cohesive fluid jet is disclosed in U.S. Pat. No. 5,226,597 issued to Ursic on Jul. 13, 1993. The orifice assembly includes a housing that receives pressurized fluid from a supply tube. The housing has a passageway therein through which the fluid flows. The passageway has an orifice element therein having an orifice for producing the fluid jet, and a converging section disposed upstream of the orifice that extends toward the orifice element. The converging section is designed to reduce turbulence upstream of the orifice and thus produce a more cohesive fluid jet emitted from the orifice. A section having a rounded surface is disposed between the converging section and the orifice element which joins the converging section and an upstream portion of the orifice element. The section is designed to further improve the cohesiveness of the fluid jet by further reducing turbulence upstream of the orifice.

Although these devices are adequate for the purpose for which they were intended, the first device has additional length and adds weight to the cutting assembly. Additionally, neither device directly addresses the problem of nozzle wear.

Another problem with prior art nozzles is the inability to easily change orifice sizes when the particular material requires such. The sapphire orifice disk is typically affixed to the nozzle housing requiring changing out of the entire nozzle, or the use of a press to remove the orifice disk from the housing. Furthermore, the same must be done to replace a worn out orifice disk. If the orifice disk cannot be removed, the entire nozzle must be scrapped.

Therefore, the need exists for an improved high velocity cutting nozzle that reduces turbulence upstream of the orifice to produce a narrow kerf, that has a significantly longer service life prior to wearing out, and having easily replaceable orifice disks.

SUMMARY OF THE INVENTION

Objectives of the invention include providing a high pressure cutting nozzle which has reduced turbulence.

Another objective is to provide a high pressure cutting nozzle with significantly reduced internal wear due to abrasion of the water flow providing a longer service life.

A further objective is to provide a high pressure cutting nozzle in which orifice disks are easily changed to ones having a different orifice size or replaced when worn out.

A still further objective of the invention is to provide such a high pressure cutting nozzle which includes a separate housing and bushing between which the orifice disk is sandwiched, and which solves problems and satisfies needs existing in the art.

These objectives and advantages are obtained by the improved high velocity cutting nozzle for connection to a fluid supply tube of a high pressure fluid cutting system of the present invention, the general nature of which may be stated as including: a housing adapted for connection to the fluid supply tube, a bushing receiving bore extending from the fluid supply tube partially through the housing, and a spray outlet bore extending inwardly from a front surface of the housing which joins with the bushing receiving bore through which the liquid is directed as a high velocity liquid cutting jet; a bushing that closely fits within the bushing receiving bore, having an end surface adapted to closely sealingly engage a mating surface of the housing within the bushing receiving bore, the bushing having a flow-directing bore for receiving the liquid from the fluid supply tube and extending at least partially through the bushing, the flow directing bore including a convergent inlet portion having an annular inner surface for reducing turbulence in the flow-directing bore, and an outlet portion having an annular inner surface and a convergent end surface; and an orifice plate in co-axial fluid communication with the flow-directing bore and the spray outlet bore, the orifice plate fitting within a sleeve receiving bore in one of the bushing and the housing immediately downstream of the flow-directing bore and abutting a shoulder of the bushing, the orifice plate having an orifice of a diameter that is smaller than a minimum diameter of the flow-directing bore for producing a high velocity fluid jet, with the orifice plate being sandwiched between the bushing and the housing.

According to another aspect, the objectives and advantages are obtained by the improved method for extending the service life of a high velocity cutting nozzle, the general nature of which may be stated as including the steps of: producing a flow of high pressure fluid; passing the flow through a flow-directing bore including a convergent inlet portion having an annular inner surface, and through an outlet portion having an annular inner surface and a convergent end surface to remove turbulence; and passing the flow through an orifice closely adjacent the flow-directing bore having an orifice of a diameter that is smaller than a minimum diameter of the flow-directing bore for producing a high velocity fluid jet.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
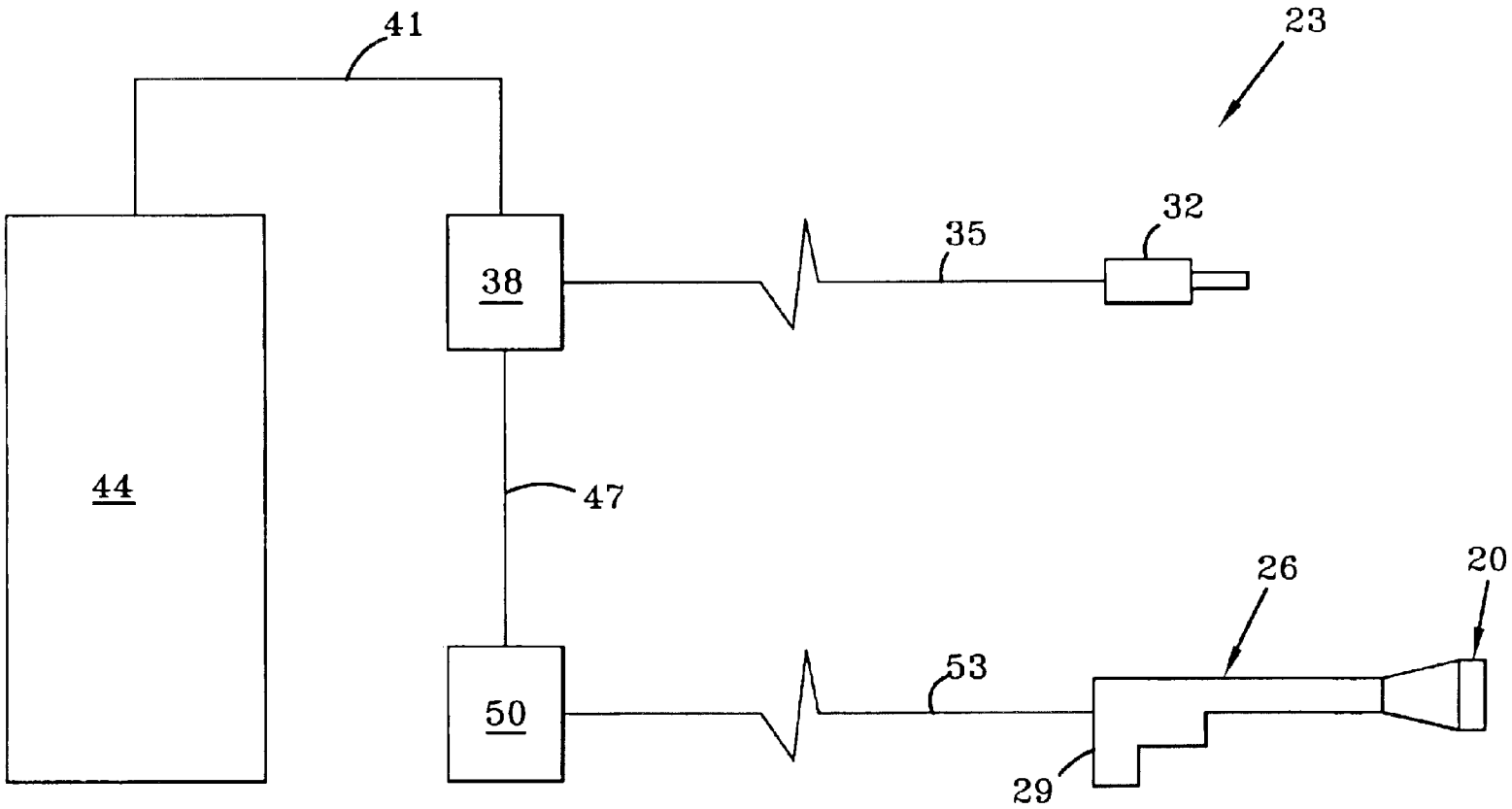
FIG. 1 is a schematic view of a high pressure water cutting system of the type that may utilize the cutting nozzles of the present invention.
Figure 2:
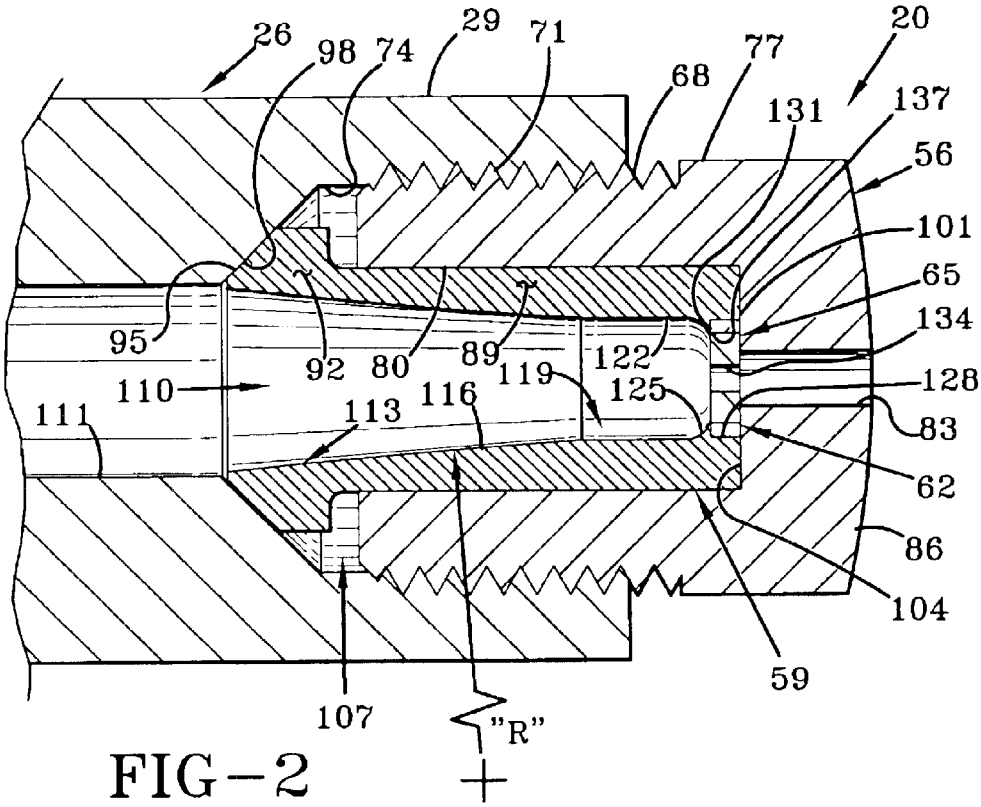
FIG. 2 is a fragmentary longitudinal sectional view of a first embodiment of the cutting nozzle of the present invention having a flow directing bore that includes a straight outlet portion having an annular straight surface and an annular curved convergent surface.

The high velocity cutting nozzle of the present invention is shown in FIGS. 1 and 2, and is indicated generally at 20. Cutting nozzle 20 is shown in FIG. 1 positioned as part of a high pressure water cutting system 23. Cutting system 23 includes a cutting gun 26 having a fluid supply tube 29 to which the cutting nozzle 20 is engaged as explained subsequently. Gun 26 receives high pressure water produced by an electric powered hydraulic pump 32 that supplies a working fluid such as hydraulic fluid through a pipe 35 to a high pressure intensifier unit 38. The intensifier unit 38 draws a suitable cutting fluid (i.e. water) through a pipe 41 from a reservoir 44, and discharges the water at a very high pressure through a pipe 47 to an ultra-fine filter 50 to remove any small particulates that might plug up the cutting nozzle 20. The water passes from filter 50 through a pipe 53 to the fluid supply tube 29 of gun 26.

Cutting nozzle 20 includes a housing 56 preferably made of high strength steel, a bushing 59 preferably made of steel, an orifice disk 62 preferably made of sapphire, and a sleeve 65 preferably made of plastic or rubber. The housing 56 is generally cylindrical in shape, having an externally threaded portion 68 configured to engage an internally threaded portion 71 of a bore 74 of fluid supply tube 26 of standard guns 26, and a wrench engaging external hexagonal portion 77 adapted to be engaged by standard hex wrenches (not shown). A bushing receiving bore 80 extends through the threaded portion 68 and partially into the hexagonal portion 77. A spray outlet bore 83 extends from a convex front surface 86 of housing 56 into the hexagonal portion 77 and joins with the bushing receiving bore 80. The bushing 59 includes a cylindrical body 89 terminating at a head 92, the body 89 being of a diameter to closely fit within the bushing receiving bore 80, with head 92 being of a larger diameter. Head 92 includes a frustoconical or annular tapered surface 95 adapted to engage a mating frustoconical or annular tapered surface 98 of fluid supply tube 29 when cutting nozzle 20 is assembled to gun 26. A flat end surface 101 of bushing 59 closely engages a mating circular surface 104 of housing 56 within bushing receiving bore 80 when bushing 59 is assembled within housing 56, with an annular space 107 remaining between head 92 and threaded portion 68. The bushing 59 further includes a flow directing bore 110 coaxially disposed with a water outlet bore 111 of fluid supply tube 29 of gun 26, the flow directing bore 110 having a longitudinally tapered inlet portion 113 having an angular funnel-shaped surface 116 and a straight outlet portion 119 having a cylindrical straight surface 122 and a cylindrical curved convergent surface 125. Surface 116 could also be slightly convex without departing from the spirit of the present invention. A sleeve receiving bore 128 extends inwardly from flat surface 101 of bushing 59 joining with the outlet portion 119 of flow directing bore 110 at a shoulder 131. The orifice disk 62 includes an orifice 134 of a desired cutting diameter, and pressfits into an inner bore 137 of sleeve 65. Sleeve 65 closely, but removably fits into the sleeve receiving bore 128 of bushing 59.

Figure 3:
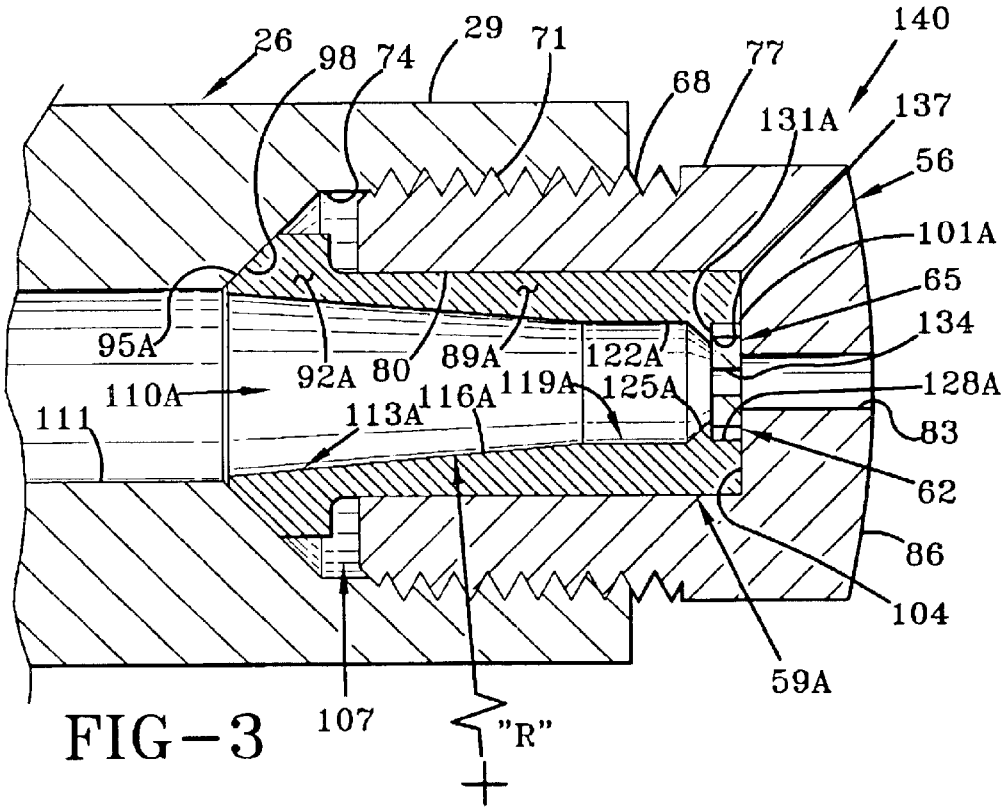
FIG. 3 is a fragmentary longitudinal sectional view of a second embodiment of the cutting nozzle of the present invention having a flow directing bore that includes a straight outlet portion having an annular straight surface and an annular angled convergent surface.

A second embodiment of the cutting nozzle of the present invention is indicated at 140 in FIG. 3. Cutting nozzle 140 includes the housing 56, a bushing 59A, the orifice disk 62, and the sleeve 65. The bushing 59A includes a cylindrical body 89A terminating at a head 92A, the body 89A being of a diameter to closely fit within the bushing receiving bore 80, with head 92A being of a larger diameter. Head 92A includes an annular tapered surface 95A adapted to engage the annular or cylindrical tapered surface 98 of fluid supply tube 29 when cutting nozzle 140 is assembled to gun 26. A flat end surface 101A of bushing 59A closely engages the circular surface 104 of housing 56 within bushing receiving bore 80 when bushing 59A is assembled within housing 56, with the annular space 107 remaining between head 92A and threaded portion 68. The bushing 59A further includes a flow directing bore 10A coaxially disposed with the water outlet bore 111 of fluid supply tube 29 of gun 26, the flow directing bore 110A having the longitudinally tapered inlet portion 113A having the funnel-shaped surface 116A and a straight outlet portion 119A having a cylindrical straight surface 122A and an annular angled convergent surface 125A. A sleeve receiving bore 128A extends inwardly from flat surface 101A of bushing 59A joining with the outlet portion 119A of flow directing bore 110A at a shoulder 131A. The orifice disk 62 includes the orifice 134 of a desired cutting diameter, and pressfits into the inner bore 137 of sleeve 65. Sleeve 65 closely, but removably fits into the sleeve receiving bore 128A of bushing 59A.

Figure 4:
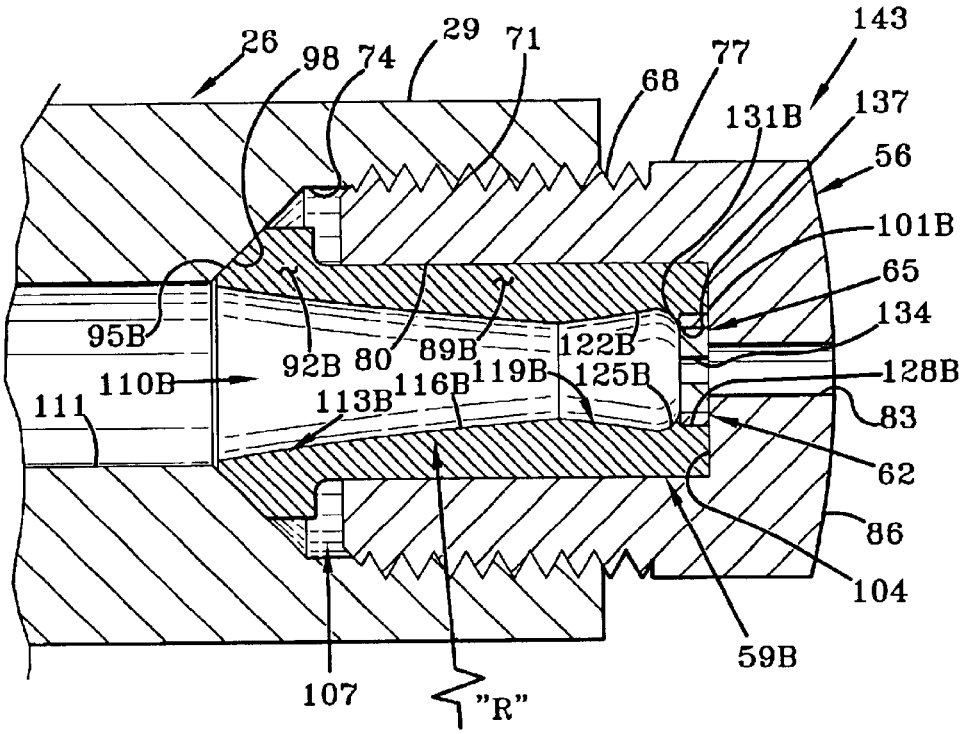
FIG. 4 is a fragmentary longitudinal sectional view of a third embodiment of the cutting nozzle of the present invention having a flow directing bore that includes a flared outlet portion having an annular flared surface and an annular curved convergent surface.

A third embodiment of the cutting nozzle of the present invention is indicated at 143 in FIG. 4. Cutting nozzle 140 includes the housing 56, a bushing 59B, the orifice disk 62, and the sleeve 65. The bushing 59B includes a cylindrical body 89B terminating at a head 92B, the body 89B being of a diameter to closely fit within the bushing receiving bore 80, with head 92B being of a larger diameter. Head 92B includes tapered surface 95B adapted to engage the tapered surface 98 of fluid supply tube 29 when cutting nozzle 140 is assembled to gun 26. A flat end surface 101B of bushing 59B closely engages the circular surface 104 of housing 56 within bushing receiving bore 80 when bushing 59B is assembled within housing 56, with the annular space 107 remaining between head 92B and threaded portion 68. The bushing 59B further includes a flow directing bore 110B coaxially disposed with the water outlet bore 111 of fluid supply tube 29 of gun 26, the flow directing bore 110B having the longitudinally tapered inlet portion 113B having a funnel-shaped surface 116B and a flared divergent outlet portion 119B having an annular flared surface 122B and an annular curved convergent surface 125B. A sleeve receiving bore 128B extends inwardly from flat surface 101B of bushing 59B joining with the outlet portion 119B of flow directing bore 110B at a shoulder 131B. The orifice disk 62 includes the orifice 134 of a desired cutting diameter, and pressfits into the inner bore 137 of sleeve 65. Sleeve 65 closely, but removably fits into the sleeve receiving bore 128B of bushing 59B.

Figure 5:
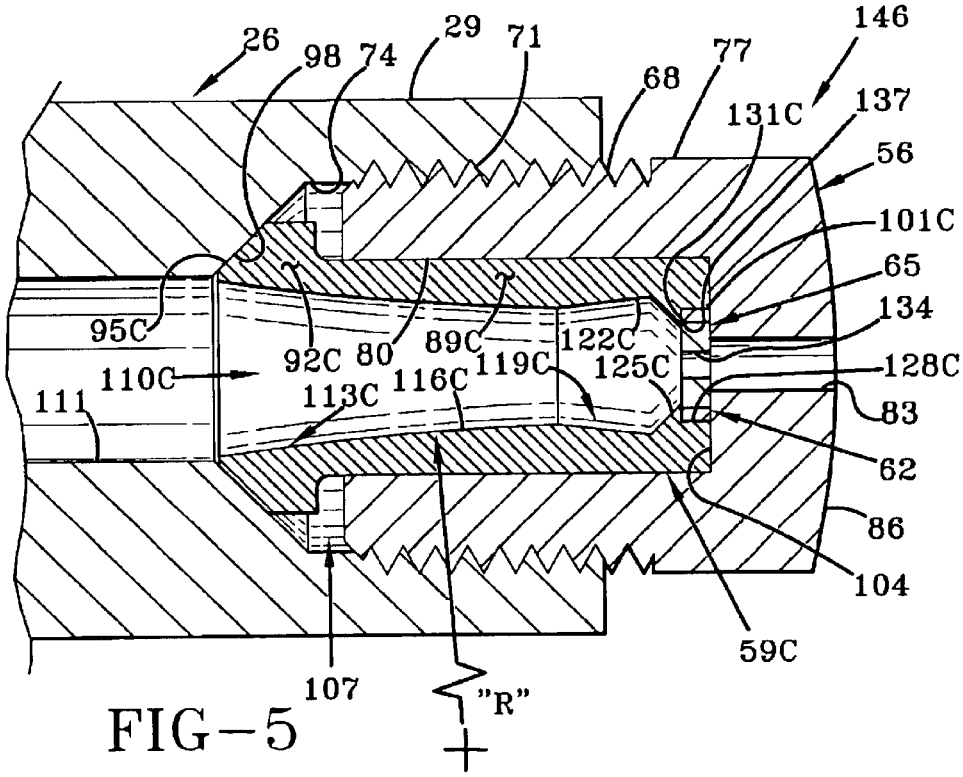
FIG. 5 is a fragmentary longitudinal sectional view of a fourth embodiment of the cutting nozzle of the present invention having a flow directing bore that includes a flared outlet portion having an annular flared surface and an annular curved convergent surface.
Figure 6:
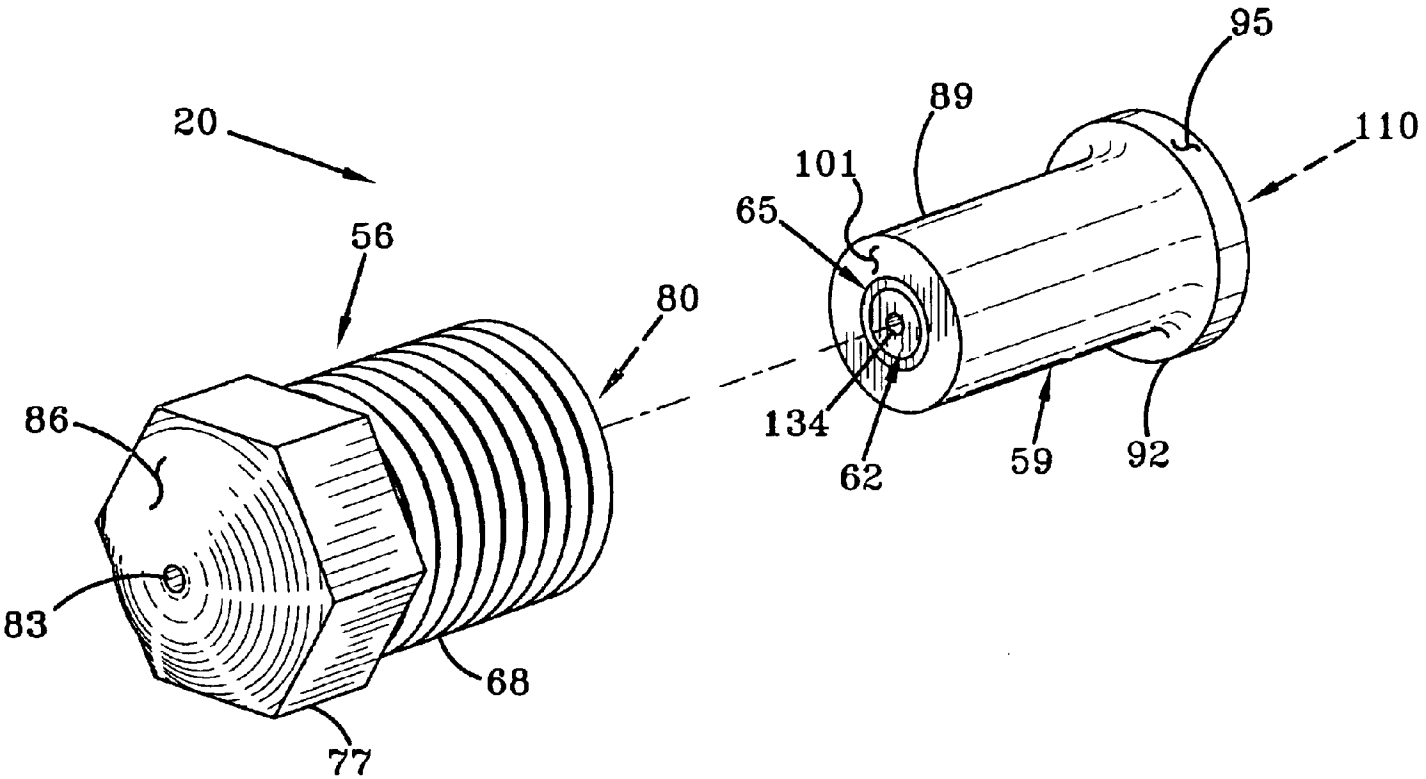
FIG. 6 is a partially exploded perspective view of the housing and bushing, with the sleeve, and orifice disk installed within the bushing of the cutting nozzles.
Figure 7:
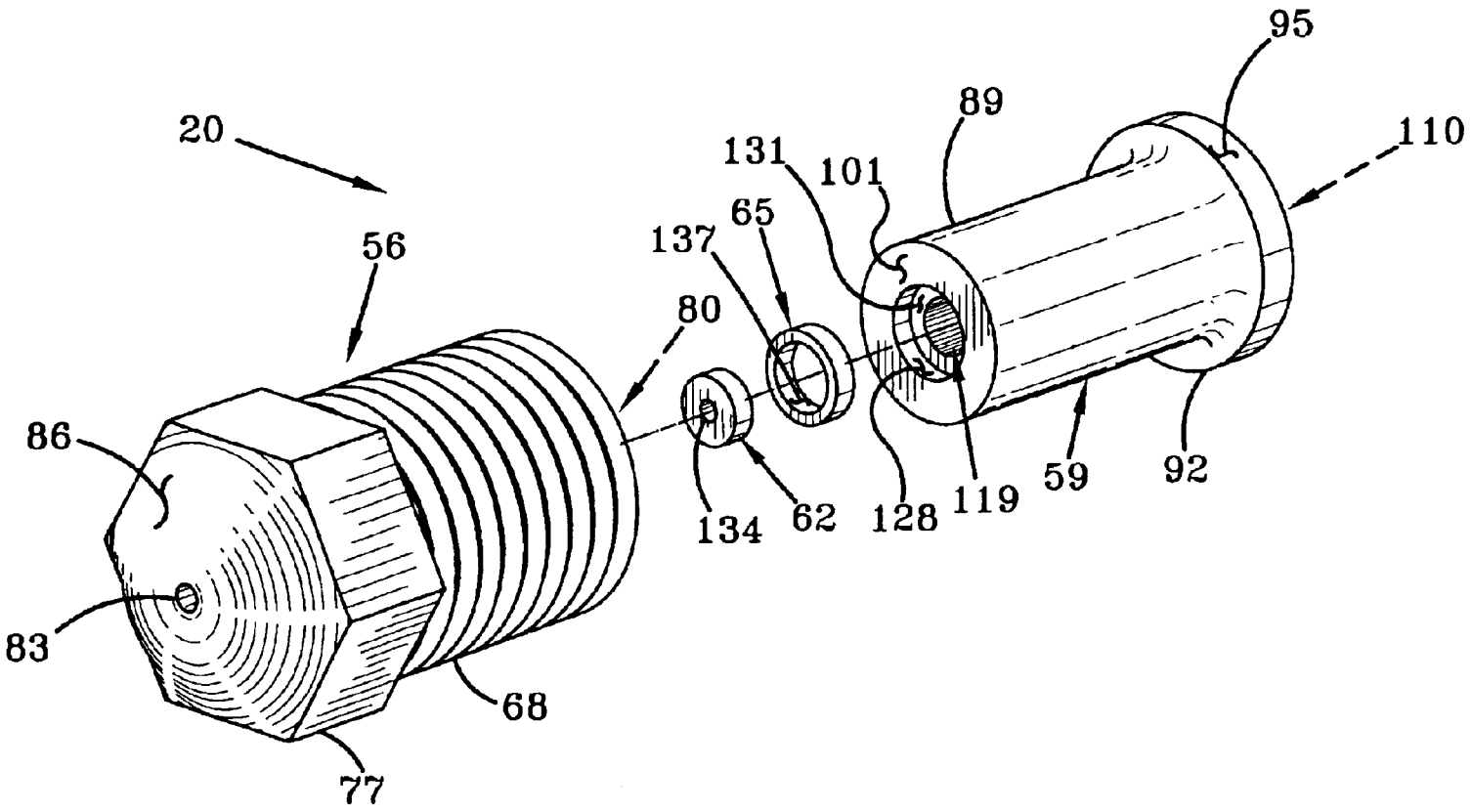
FIG. 7 is an exploded perspective view of the housing, bushing, sleeve, and orifice disk of the cutting nozzle.
Figure 8:
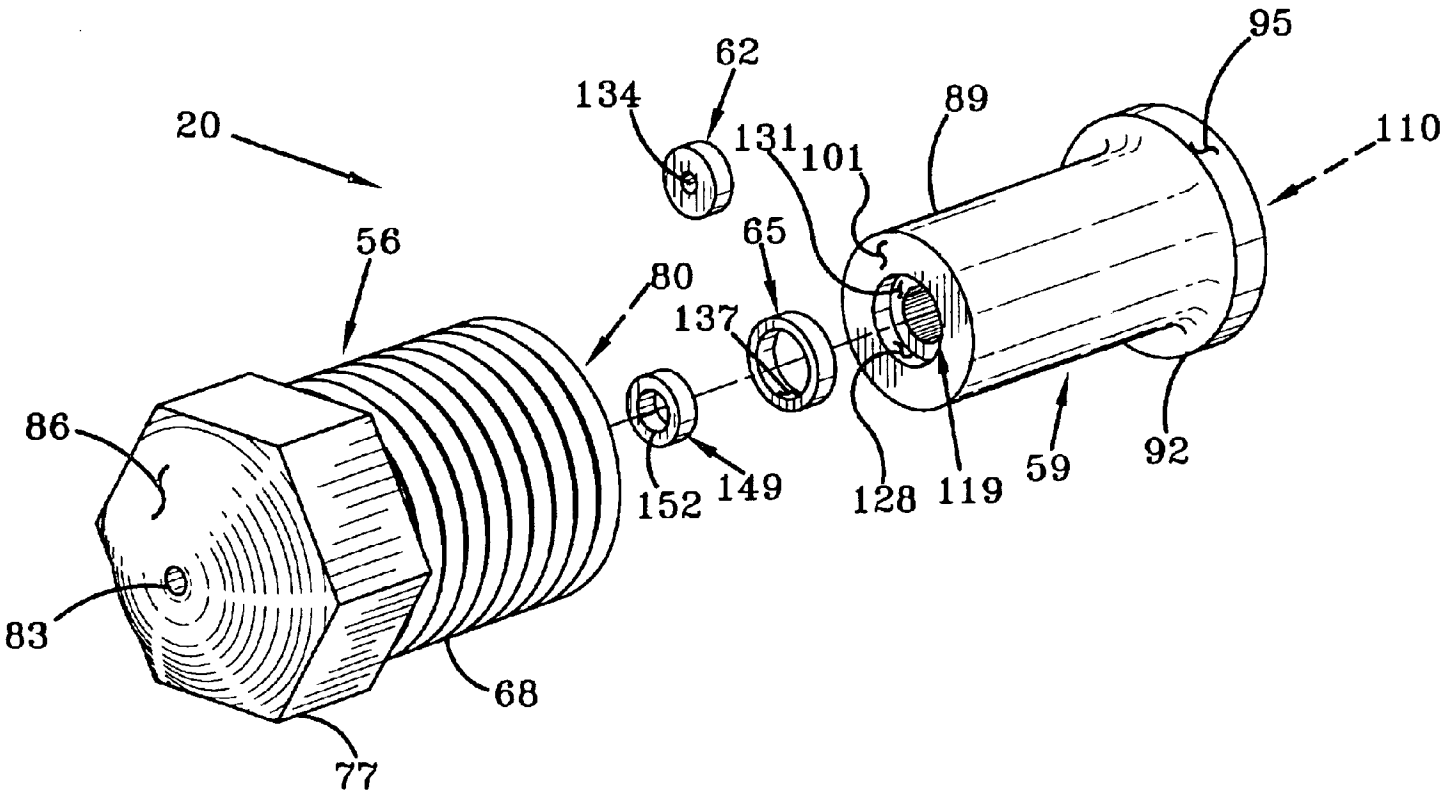
FIG. 8 is an exploded perspective view of the housing, bushing, sleeve, orifice disk, and an alternate orifice disk having a larger orifice of the cutting nozzle.
Figure 9:
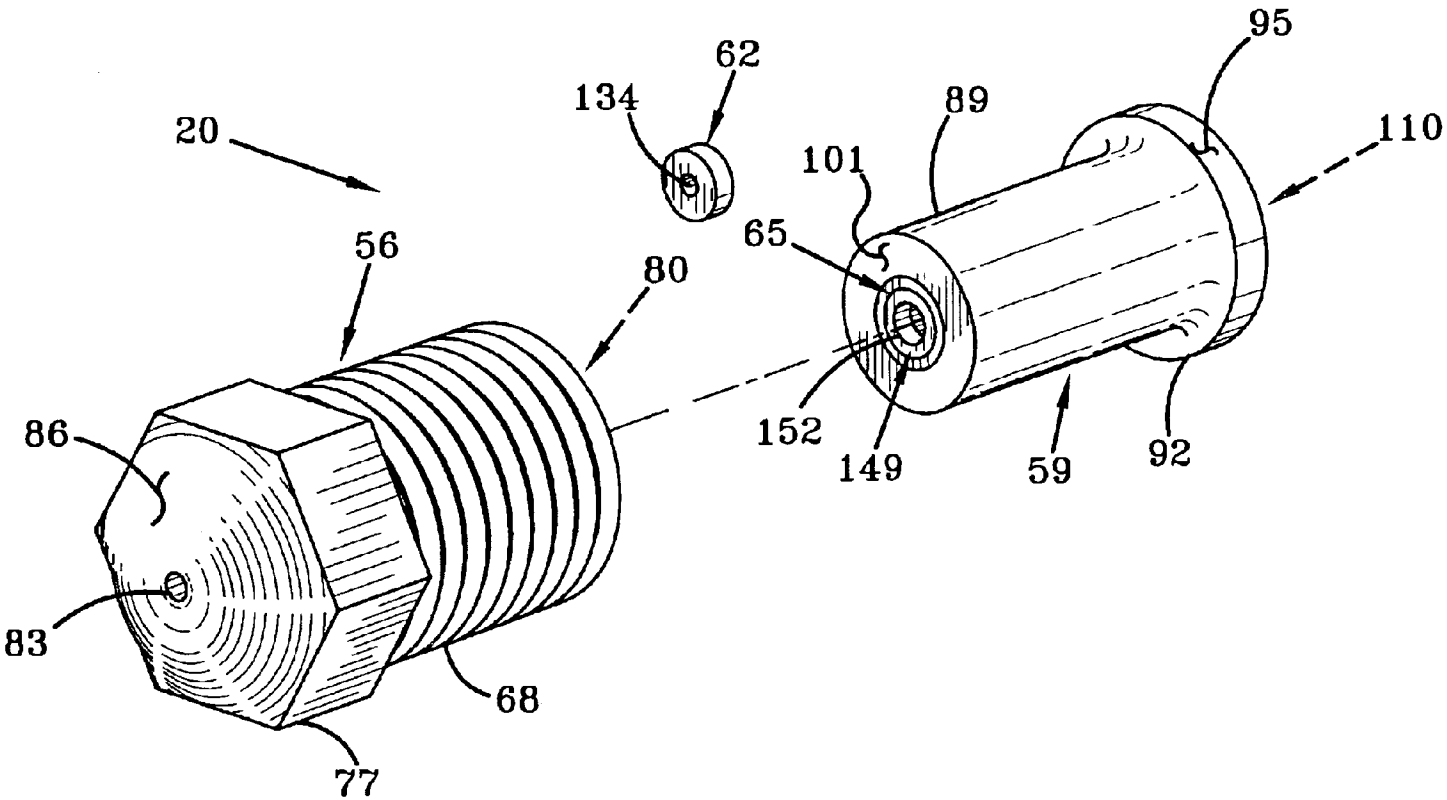
FIG. 9 is a partially exploded perspective view of the housing, bushing, and orifice disk, with the sleeve, and alternate orifice disk installed within the bushing of the cutting nozzle.

A fourth embodiment of the cutting nozzle of the present invention is indicated at 146 in FIG. 5. Cutting nozzle 140 includes the housing 56, a bushing 59C, the orifice disk 62, and the sleeve 65. The bushing 59C includes a cylindrical body 89C terminating at a head 92C, the body 89C being of a diameter to closely fit within the bushing receiving bore 80, with head 92C being of a larger diameter. Head 92C includes an annular tapered surface 95C adapted to engage the annular tapered surface 98 of fluid supply tube 29 when cutting nozzle 140 is assembled to gun 26. A flat end surface 101C of bushing 59C closely engages the circular surface 104 of housing 56 within bushing receiving bore 80 when bushing 59C is assembled within housing 56, with the annular space 107 remaining between head 92C and threaded portion 68. The bushing 59C further includes a flow directing bore 110C coaxially disposed with the water outlet bore 111 of fluid supply tube 29 of gun 26, the flow directing bore 110C having the longitudinally tapered inlet portion 113C having a funnel-shaped surface 116C and a flared divergent outlet portion 119C having an annular flared surface 122C and an annular curved convergent surface 125C. A sleeve receiving bore 128C extends inwardly from flat surface 101C of bushing 59C joining with the outlet portion 119C of flow directing bore 110C at a shoulder 131C. The orifice disk 62 includes the orifice 134 of a desired cutting diameter, and pressfits into the inner bore 137 of sleeve 65. Sleeve 65 closely, but removably fits into the sleeve receiving bore 128C of bushing 59C.

The cutting nozzle 20 (as well as cutting nozzles 140, 143, and 146) threadably connects to the fluid supply tube 29 of gun 26 by engaging a wrench to the external hexagonal portion 77 of housing 56. The annular tapered surface 95 of bushing 59 engages the annular tapered surface 98 of fluid supply tube 29 as cutting nozzle 20 is tightened, forcing bushing 59 further into the bushing receiving bore 80. The flat end surface 101 of bushing 59 closely engages the mating circular surface 104 of housing 56 within bushing receiving bore 80, sealing nozzle 20 to fluid supply tube 29. The orifice disk 62 and sleeve 65 are retained within the sleeve receiving bore 128 by the shoulder 131 without being pressfit or otherwise affixed therein. Therefore, upon disassembly of cutting nozzle 20, the orifice disk 62 with sleeve 65 readily slides out of the sleeve receiving bore 128 without using tools, and may be replaced by an orifice disk 149 within another sleeve 65 having a different size orifice 152 to suite a different cutting job. Likewise, when orifice disk 62 wears out, it may readily be replaced without throwing out the entire cutting nozzle 20. The cutting nozzle 20 fastens directly to conventional fluid supply tubes 29 and requires no modification thereto.

The method of operation includes the following steps: 1) producing a flow of high pressure fluid; 2) passing the flow through a flow-directing bore including a convergent inlet portion having an annular inner surface, and through an outlet portion having an annular inner surface and a convergent end surface to remove turbulence; and 3) passing the flow through an orifice closely adjacent the flow-directing bore having an orifice of a diameter that is smaller than a minimum diameter of the flow-directing bore for producing a high velocity fluid jet. The outlet portion has one of four configurations: a) the annular inner surface is a cylindrical surface with an annular curved convergent surface downstream thereof; b) the annular inner surface is a cylindrical surface with an annular straight convergent surface downstream thereof; c) the annular inner surface is an annular straight divergent surface with an annular curved convergent surface downstream thereof; and d) the annular inner surface is an annular straight divergent surface and an annular straight convergent surface downstream thereof. In operation, it is believed that the inwardly convex convergent inlet portion of the flow directing bore stabilizes the flow of water to reduces turbulence in the flow-directing bore, producing a more laminar and coherent flow prior to entering the orifice. The various configurations of the outlet portion augment this process by smoothly directing the flow into the orifice, with or without a slight initial expansion of the flow area prior to entering the orifice. The result is less turbulence in the flow producing less wear and a tighter kerf.

It is understood that various materials other than those listed may be used in the construction of the cutting nozzles and various finishes be applied. For example, the bushing might be made of brass or a sand blast finish applied to all the water contacting surfaces rather than a smooth finish to improve cohesiveness of the flow. Also, other housing and bushing configurations may be devised. For example, the sleeve receiving bore may be disposed in the housing rather than in the bushing.

Accordingly, the cutting nozzles provide reduced turbulence to produce a finer kerf, significantly reduced internal wear due to abrasion of the water flow providing a longer service life, orifice disks that are easily changed to ones having a different orifice size or replaced when worn out, and a separate housing and bushing between which the orifice disk is sandwiched which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved high velocity cutting nozzle is constructed and used, the characteristics of the construction, and the advantageous, new and useful results obtained; the new and useful structures, devices, elements, arrangements, parts and combinations, are set forth in the appended claims.

TERMS

20. first embodiment cutting nozzle
23. high pressure water cutting system
26. [cutting system] cutting gun
29. [gun] fluid supply tube
32. [cutting system] electric powered hydraulic pump
35. [cutting system] pipe
38. [cutting system] high pressure intensifier pump
41. [cutting system] pipe
44. [cutting system] reservoir
47. [cutting system] pipe
50. [cutting system] ultra-fine filter
53. [cutting system] pipe
56. [cutting nozzle] housing
59. [cutting nozzle] bushing
62. [cutting nozzle] orifice disk
65. [cutting nozzle] sleeve
68. [cutting nozzle] externally threaded portion
71. [fluid supply tube] internally threaded portion
74. [gun] bore
77. [housing] externally hexagonal portion
80. [housing] bushing receiving bore
83. [housing] spray outlet bore
86. [housing] convex front surface
89. [bushing] body
92. [bushing] head
95. [head] annular tapered surface
98. [gun] annular tapered surface
101. [bushing] flat end surface
104. [housing] circular surface
107. [cutting nozzle] annular surface
110. [bushing] flow directing bore
111. [gun] water outlet bore
113. [bore] longitudinally tapered inlet portion
116. [bore] annular concave surface
"R" radius
119. [bore] bulbous outlet portion
122. [outlet portion] annular straight surface
125. [outlet portion] annular curved convergent surface
128. [bushing] sleeve receiving bore
131. [bushing] shoulder
134. [orifice disk] orifice
137. [sleeve] inner bore
140. second embodiment cutting nozzle
143. third embodiment cutting nozzle
146. fourth embodiment cutting nozzle
149. [cutting nozzle] alternate orifice disk
152. [orifice disk] orifice

What is claimed is:

1. A high velocity nozzle for connection to a fluid supply tube of a high pressure fluid cutting system, comprising:

a housing adapted for connection to the fluid supply tube, a bushing receiving bore extending from the fluid supply tube partially through said housing, and a spray outlet bore extending inwardly from a front surface of said housing which communicates with said bushing receiving bore through which the liquid is directed as a high velocity liquid jet;

a bushing having an upstream end surface and a downstream end surface opposed to the upstream end surface, the bushing closely fitting within said bushing receiving bore and the downstream end surface being adapted to closely sealingly engage a mating surface of said housing within said bushing receiving bore, said bushing having a flow-directing bore for receiving the liquid from the fluid supply tube and extending at least partially through said bushing, said flow directing bore including a convergent inlet portion having an annular inner surface for reducing turbulence in said flow-directing bore, and an outlet portion formed with a convergent end surface and an annular inner surface between the convergent end surface and the convergent inlet portion; and an orifice plate disposed adjacent the downstream end surface of the bushing and intermediate the bushing and the housing, the orifice plate defining an orifice in coaxial fluid communication with the flow-directing bore and the outlet bore; the orifice having a diameter smaller than a minimum diameter of said flow-directing bore for producing a high velocity fluid jet.

2. The high velocity nozzle as defined in claim 1 wherein said orifice plate fits within a sleeve receiving bore in one of said bushing and said housing immediately downstream of said flow-directing bore and wherein the orifice plate has an upstream end which abuts said bushing and a downstream end which abuts said housing.

3. The nozzle defined in claim 2 in which the orifice plate is removably positioned into the sleeve receiving bore so that the orifice plate is removable therefrom for replacement upon removal of said housing and bushing from the fluid supply tube.

4. The nozzle defined in claim 3 in which the orifice plate comprises an orifice disk.

5. The nozzle defined in claim 4 further comprising a tubular support sleeve having an inner bore into which the orifice plate is affixed.

6. The nozzle defined in claim 2 in which the orifice plate comprises a jewel orifice.

7. The nozzle defined in claim 6 in which the jewel orifice is sapphire.

8. The nozzle defined in claim 1 in which a sleeve receiving bore extends inwardly from the downstream end surface of the bushing and is in communication with the outlet portion of the flow directing bore at a shoulder.

9. The nozzle defined in claim 1 in which the bushing comprises a cylindrical body having a rearwardly tapering frustoconical surface opposite the downstream end surface for contacting a mating frustoconical surface of the fluid supply tube so as to form a seal between said housing and the fluid supply tube and retain said end surface of said bushing closely sealingly engaged with the mating surface of the housing within said bushing receiving bore.

10. The nozzle defined in claim 9 in which the frustoconical surface is disposed about a tapered head of the bushing, said tapered head being of a larger diameter than a remainder of the body, with an annular space remaining between said tapered head and the housing when said bushing is assembled to said housing.

11. The nozzle defined in claim 9 in which the housing includes an externally threaded portion configured to engage a mating internally threaded portion of the fluid supply tube, and an external wrench engaging portion for tightening said housing to the fluid supply tube.

12. The nozzle defined in claim 1 in which the annular inner surface of the outlet portion comprises a cylindrical surface with an annular curved convergent surface downstream thereof.

13. The nozzle defined in claim 1 in which the annular inner surface of the outlet portion comprises a cylindrical surface with an annular straight convergent surface downstream thereof.

14. The nozzle defined in claim 1 in which the annular inner surface of the outlet portion comprises a straight divergent surface with an annular curved convergent surface downstream thereof.

15. The nozzle defined in claim 1 in which the annular inner surface of the outlet portion comprises a straight divergent surface with an annular straight convergent surface downstream thereof.

16. The nozzle defined in claim 1 in which the annular inner surface of the convergent inlet portion is slightly inwardly convex.

17. The nozzle defined in claim 16 in which the annular inner surface of the outlet portion comprises a cylindrical surface with an annular curved convergent surface downstream thereof.

18. The nozzle defined in claim 16 in which the annular inner surface of the outlet portion comprises a cylindrical surface with an annular straight convergent surface downstream thereof.

19. The nozzle defined in claim 16 in which the annular inner surface of the outlet portion comprises a straight divergent surface with an annular curved convergent surface downstream thereof.

20. The nozzle defined in claim 16 in which the annular inner surface of the outlet portion comprises a straight divergent surface with an annular straight convergent surface downstream thereof.

21. The nozzle defined in claim 1 in which the housing has an open end and in which the bushing is seated in the housing through the open end and in which the fluid flows through the bushing and housing by entering the open end.

22. The nozzle defined in claim 21 in which the bushing is adapted to be tightly seated by the fluid flow direction.

23. A high velocity cutting nozzle for connection to a fluid supply tube of a high pressure fluid cutting system, comprising:

a housing adapted for connection to the fluid supply tube, a bushing receiving bore extending from the fluid supply tube partially through said housing, and an outlet bore extending inwardly from a front surface of the housing which communicates with said bushing receiving bore;

a bushing having an upstream end surface and a downstream end surface opposed to the upstream end surface, the bushing closely fitting within said bushing receiving bore and the downstream end surface being adapted to closely sealingly engage a mating surface of said housing within said bushing receiving bore, said bushing having a flow-directing bore for receiving the liquid from the fluid supply tube and extending at least partially through said bushing, said flow directing bore including a convergent inlet portion having an annular convergent inner surface, and an outlet portion having an annular inner surface and a convergent end surface, and a sleeve receiving bore that extends inwardly from said end surface of said bushing and joining with said outlet portion of said flow directing bore at a shoulder;

a tubular sleeve which has an inner bore and which removably slip fits into said sleeve receiving bore of said bushing abutting said shoulder;

an orifice disk affixed within said inner bore of said tubular support sleeve, said orifice disk having an orifice of a diameter that is smaller than a minimum diameter of said flow-directing bore for producing a high velocity fluid jet, said orifice disk being positioned intermediate said bushing and said housing; and wherein said orifice disk removably slip fits into said sleeve receiving bore during use but is removable for replacement upon removal of said housing and bushing from the fluid supply tube.

24. The nozzle defined in claim 23 in which the annular inner surface of the outlet portion comprises a cylindrical surface with an annular curved convergent surface downstream thereof.

25. The nozzle defined in claim 23 in which the annular inner surface of the outlet portion comprises a cylindrical surface with an annular straight convergent surface downstream thereof.

26. The nozzle defined in claim 23 in which the annular inner surface of the outlet portion comprises an annular straight divergent surface with an annular curved convergent surface downstream thereof.

27. The nozzle defined in claim 23 in which the annular inner surface of the outlet portion comprises an annular straight divergent surface and an annular straight convergent surface downstream thereof.

28. The nozzle of claim 1 wherein the convergent inlet portion has an upstream end and a downstream end; wherein the outlet portion has an upstream end coincident with the downstream end of the inlet portion; and wherein the annular inner surface of the convergent inlet portion is straight from the upstream end of the inlet portion to the downstream end of the inlet portion.

29. The nozzle of claim 1 wherein the housing and the bushing are free of a divergent section upstream of the convergent inlet portion.

30. A nozzle for use with a high-pressure fluid cutting system having a fluid supply tube with an internally threaded end portion, the nozzle comprising:

a housing defining a bushing-receiving bore extending partially through the housing and an outlet bore extending inwardly from a front surface of the housing and in fluid communication with the bushing-receiving bore; the housing having an externally threaded portion for threadedly engaging the end portion of the fluid supply tube to connect the housing to the fluid supply tube;

a bushing having an upstream end surface and a downstream end surface opposed to the upstream end surface; the bushing being matingly received within the bushing-receiving bore with the upstream end surface disposed upstream of the bushing-receiving bore; the bushing defining a flow-directing bore extending from the upstream end surface of the bushing at least partially through said bushing; the flow-directing bore in fluid communication with the outlet bore of the housing adjacent the downstream end surface of the bushing; and an orifice plate disposed adjacent the downstream end surface of the bushing and intermediate the bushing and the housing, the orifice plate defining an orifice in coaxial fluid communication with the flow-directing bore and the outlet bore; the orifice having a diameter smaller than a minimum diameter of said flow-directing bore for producing a high-velocity fluid jet.

31. The nozzle of claim 30 wherein the orifice plate fits within a sleeve receiving bore formed in at least one of the bushing and the housing and wherein the orifice plate has an upstream end which abuts the bushing and a downstream end which abuts the housing.

32. The nozzle defined in claim 30 wherein the orifice plate is removable from the housing and bushing for replacement upon removal of the bushing from the bushing-receiving bore of the housing.

33. The nozzle of claim 30 wherein the housing is an integral one-piece member and the bushing is an integral one-piece member.

34. The nozzle of claim 30 wherein the flow directing bore includes a convergent inlet portion having an annular inner surface for reducing turbulence in the flow-directing bore and an outlet portion having a convergent end surface and an annular inner surface between the convergent end surface and the convergent inlet portion.

35. The nozzle defined in claim 34 in which the annular inner surface of the outlet portion comprises a straight divergent surface with an annular curved convergent surface downstream thereof.

36. The nozzle defined in claim 34 in which the annular inner surface of the convergent inlet portion is slightly inwardly convex.

37. The nozzle defined in claim 30 wherein the flow-directing bore has an annular inner surface which is slightly inwardly convex.

* * * * *